US012778204B2

(12) United States Patent
Li et al.

(10) Patent No.: US 12,778,204 B2
(45) Date of Patent: Nov. 3, 2026

(54) E-CIGARETTE CARTRIDGE WITH VAPOR OUTPUT CHANNEL HAVING FIRST AND SECOND CHANNEL PARTS AND E-CIGARETTE

(71) Applicant: SHENZHEN FIRST UNION TECHNOLOGY CO., LTD., Shenzhen City (CN)

(72) Inventors: Yinzhe Li, Shenzhen City (CN); Jun Yuan, Shenzhen City (CN); Weifeng Gong, Shenzhen City (CN); Linhai Lu, Shenzhen City (CN); Yuanqiu Xie, Shenzhen City (CN); Ruilong Hu, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 393 days.

(21) Appl. No.: 18/029,648

(22) PCT Filed: Sep. 29, 2021

(86) PCT No.: PCT/CN2021/121781
§ 371 (c)(1),
(2) Date: Mar. 30, 2023

(87) PCT Pub. No.: WO2022/068889
PCT Pub. Date: Apr. 7, 2022

(65) Prior Publication Data

US 2023/0380497 A1 Nov. 30, 2023

(30) Foreign Application Priority Data

Sep. 30, 2020 (CN) ..... 202022220439.9

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/46* (2020.01); *A24F 40/50* (2020.01); *A24F 40/51* (2020.01)

(58) Field of Classification Search
CPC ..... A24F 40/10; A24F 40/42; A24F 40/46; A24F 40/48; A24F 40/485
See application file for complete search history.

(56) References Cited

U.S. PATENT DOCUMENTS

2014/0076310 A1* 3/2014 Newton ..... A61M 15/06 128/202.21
2022/0007731 A1* 1/2022 Lei ..... A24F 40/42

FOREIGN PATENT DOCUMENTS

CN 209234986 U 8/2019
CN 110250582 A 9/2019
(Continued)

*Primary Examiner* — Michael H. Wilson
*Assistant Examiner* — Michael Patrick Mullen
(74) *Attorney, Agent, or Firm* — Scully, Scott, Murphy & Presser, P.C.

(57) ABSTRACT

An e-cigarette cartridge includes a housing with an air inlet and an air outlet; and the housing is provided with a liquid storage cavity, a porous body, a vaporization cavity, a heating element, a support frame, and a vapor output channel, where the vaporization cavity is in airflow communication with the air inlet; the support frame is constructed to provide the porous body with support and holding; and the vapor output channel includes a first channel part and a second channel part that are formed on the support frame and extend in a width direction of the housing. One end of the first channel part is in communication with the vapor-
(Continued)

ization cavity and the other end is in communication with the air outlet; one end of the second channel part is in airflow communication with the vaporization cavity and the other end is in airflow communication with the air outlet.

9 Claims, 6 Drawing Sheets

(51) Int. Cl.

| | |
|---|---|
| ***A24F 40/42*** | (2020.01) |
| ***A24F 40/46*** | (2020.01) |
| *A24F 40/50* | (2020.01) |
| *A24F 40/51* | (2020.01) |

(56) References Cited

FOREIGN PATENT DOCUMENTS

| | | | | | |
|---|---|---|---|---|---|
| CN | 209931491 | U | | 1/2020 | |
| CN | 210203316 | U | | 3/2020 | |
| CN | 210611013 | U | | 5/2020 | |
| CN | 111329115 | A | | 6/2020 | |
| CN | 214127021 | U | | 9/2021 | |
| EP | 3360430 | A2 | * | 8/2018 | ..... H05B 1/0227 |
| WO | WO-2020065248 | A1 | * | 4/2020 | ..... A24F 1/00 |

* cited by examiner

E-CIGARETTE CARTRIDGE WITH VAPOR OUTPUT CHANNEL HAVING FIRST AND SECOND CHANNEL PARTS AND E-CIGARETTE

CROSS-REFERENCE TO RELATED APPLICATIONS

This application is a 35 U.S.C. § 371 National Phase conversion of International (PCT) Patent Application No. PCT/CN2021/121781, filed on Sep. 29, 2021, which claims priority to Chinese Patent Application No. 202022220439.9, entitled "E-CIGARETTE CARTRIDGE AND E-CIGARETTE" and filed with the China National Intellectual Property Administration on Sep. 30, 2020, which is incorporated herein by reference in its entirety. The PCT International Patent Application was filed and published in Chinese.

TECHNICAL FIELD

Embodiments of this application relate to the field of e-cigarette technologies, and particularly, to an e-cigarette cartridge and an e-cigarette.

BACKGROUND

An e-cigarette, also known as a virtual cigarette or an electronic cigarette, has an appearance same as those of cigarettes and a taste similar to those of the cigarettes, and even more tastes than those of the general cigarettes. Smoke, a taste, and feel can also be sucked out from the e-cigarette like the cigarettes, and the e-cigarette is mainly used for smoking cessation and alternative cigarettes.

The e-cigarette usually vaporizes, through a vaporizer, an e-liquid into an aerosol for a user to smoke. The e-liquid is manufactured with tar and other substances that are physically damaging removed, eliminating a harm to the human body. Existing e-cigarettes are prone to non-uniform mixing of air and an aerosol that reaches a smoker's mouth, affecting the user's inhaling experience.

SUMMARY

This application mainly provides an e-cigarette cartridge and an e-cigarette to resolve the foregoing technical problem, an aerosol formed by vaporization of a vaporization assembly of the e-cigarette and air can be fully mixed, thereby improving mixing uniformity of the aerosol and the air.

To resolve the foregoing technical problem, this application adopts a technical solution as follows: an e-cigarette cartridge is provided, including a housing with a near end and a far end facing away from each other in a longitudinal direction, where the far end is provided with an air inlet and the near end is provided with an air outlet; and the housing is internally provided with a liquid storage cavity, a porous body, a vaporization cavity, a heating element, a support frame, and a vapor output channel, where the liquid storage cavity is configured to store a liquid substrate; the porous body is in fluid communication with the liquid storage cavity to suck the liquid substrate and has a vaporization surface; the vaporization cavity is at least partially defined by the vaporization surface, where the vaporization cavity is in airflow communication with the air inlet; the heating element is formed on the vaporization surface and configured to heat at least a part of the liquid substrate in the porous body to generate an aerosol; the support frame is constructed to provide the porous body with support and holding; and the vapor output channel includes a first channel part and a second channel part that are formed on the support frame and extend in a direction of a width of the housing, where one end of the first channel part is in airflow communication with the vaporization cavity and the other end is in airflow communication with the air outlet; one end of the second channel part is in airflow communication with the vaporization cavity and the other end is in airflow communication with the air outlet; and further the aerosol in the vaporization cavity is divided into two flows by the first channel part and the second channel part in use, and then the two flows are merged and outputted to the air outlet.

This application further includes another technical solution: an e-cigarette is provided, including the foregoing e-cigarette cartridge and a power supply device for supplying power to the e-cigarette cartridge.

This application has the following beneficial effects: Different from an existing technology, in an e-cigarette cartridge in embodiments of this application, a vapor output channel is provided with two channels, namely, a first channel part and a second channel part extending in a direction of a width of a housing, to lengthen a path of the vapor output channel without increasing a volume of the housing. Air and an aerosol can be fully mixed in the vapor output channel, so that uniformity of mixed gas of the aerosol flowing out from an air outlet and the air is high.

BRIEF DESCRIPTION OF THE DRAWINGS

One or more embodiments are described by way of example with reference to the corresponding figures in the accompanying drawings, and the exemplary descriptions are not to be construed as limiting the embodiments. Elements/modules and steps in the accompanying drawings that have same reference numerals are represented as similar elements/modules and steps, and unless otherwise particularly stated, the figures in the accompanying drawings are not drawn to scale.

DETAILED DESCRIPTION

Figure 1:
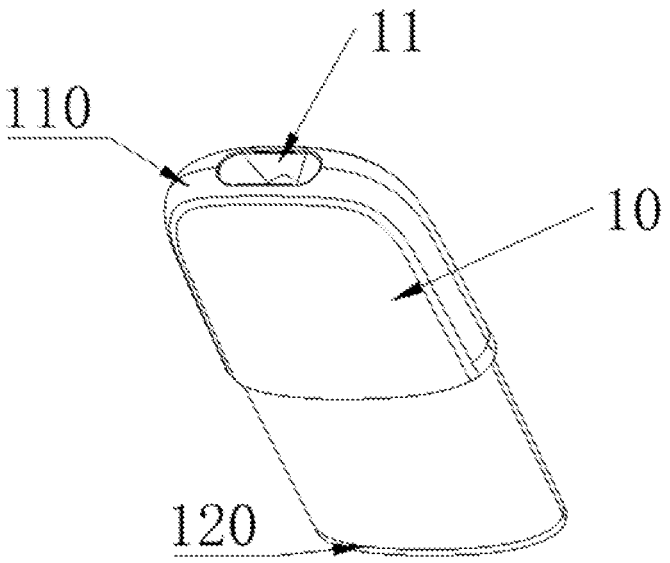
FIG. 1 is a schematic three-dimensional structural diagram from a perspective of an e-cigarette cartridge according to an embodiment of this application.

In order to make the objectives, technical solutions, and effects of this application more comprehensible and clearer, this application is described in further detail below by describing embodiments with reference to the accompanying drawings.

An embodiment of this application provides an e-cigarette cartridge, as shown in FIG. 1 to FIG. 6, including a housing 10 with a near end 110 and a far end 120 facing away from each other in a longitudinal direction D1, where the far end 120 is provided with an air inlet 12 and the near end 110 is provided with an air outlet 11; and the housing 10 is internally provided with a liquid storage cavity 13, a porous body 52, a vaporization cavity 54, a heating element 53, a support frame 30, and a vapor output channel 40, where the liquid storage cavity 13 is configured to store a liquid substrate; the porous body 52 is in fluid communication with the liquid storage cavity 13 to suck the liquid substrate and has a vaporization surface 521; the vaporization cavity 54 is at least partially defined by the vaporization surface 521, where the vaporization cavity 54 is in airflow communication with the air inlet 12; the heating element 53 is formed on the vaporization surface 521 and configured to heat at least a part of the liquid substrate in the porous body 52 to generate an aerosol; the support frame 30 is constructed to provide the porous body 52 with support and holding; and the vapor output channel 40 includes a first channel part 41 and a second channel part 42 that are formed on the support frame 30 and extend in a direction of a width L of the housing 10, where one end of the first channel part 41 is in airflow communication with the vaporization cavity 54 and the other end is in airflow communication with the air outlet 11; one end of the second channel part 42 is in airflow communication with the vaporization cavity 54 and the other end is in airflow communication with the air outlet 11; and further the aerosol in the vaporization cavity 54 is divided into two flows by the first channel part 41 and the second channel part 42 in use, and then the two flows are merged and outputted to the air outlet 11.

The above is core content of this embodiment of this application, the vapor output channel 40 is provided with two channels, namely, the first channel part 41 and the second channel part 42 extending in the direction of the width L of the housing 10, to lengthen a path of the vapor output channel 40 without increasing a volume of the housing 10. When the path of the vapor output channel 40 is long, air carrying the aerosol in the vaporization cavity 54 can be fully mixed in the vapor output channel 40, to improve mixing uniformity of the aerosol and the air, so that uniformity of mixed gas of the aerosol flowing out from the air outlet 11 and the air is high.

Figure 2:
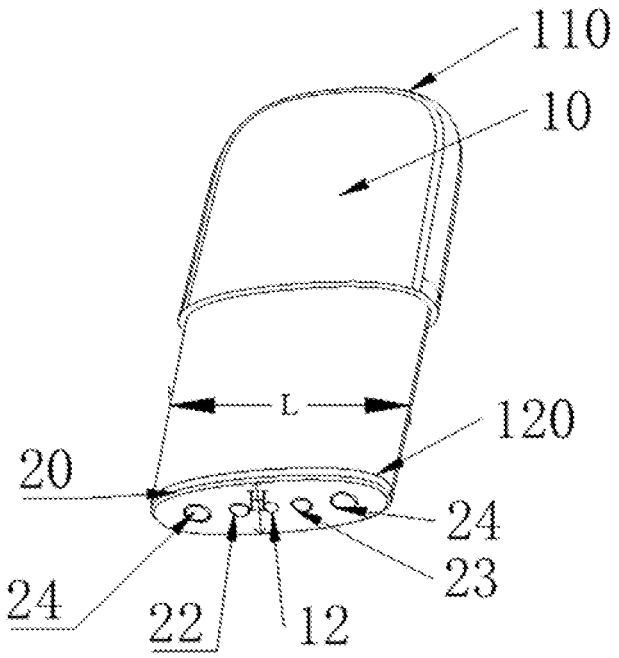
FIG. 2 is a schematic three-dimensional structural diagram from another perspective of an e-cigarette cartridge according to an embodiment of this application.

In this embodiment of this application, as shown in FIG. 2, the width L of the housing 10 is greater than a thickness H of the housing 10. The liquid substrate stored in the liquid storage cavity 13 is an e-liquid.

Figure 5:
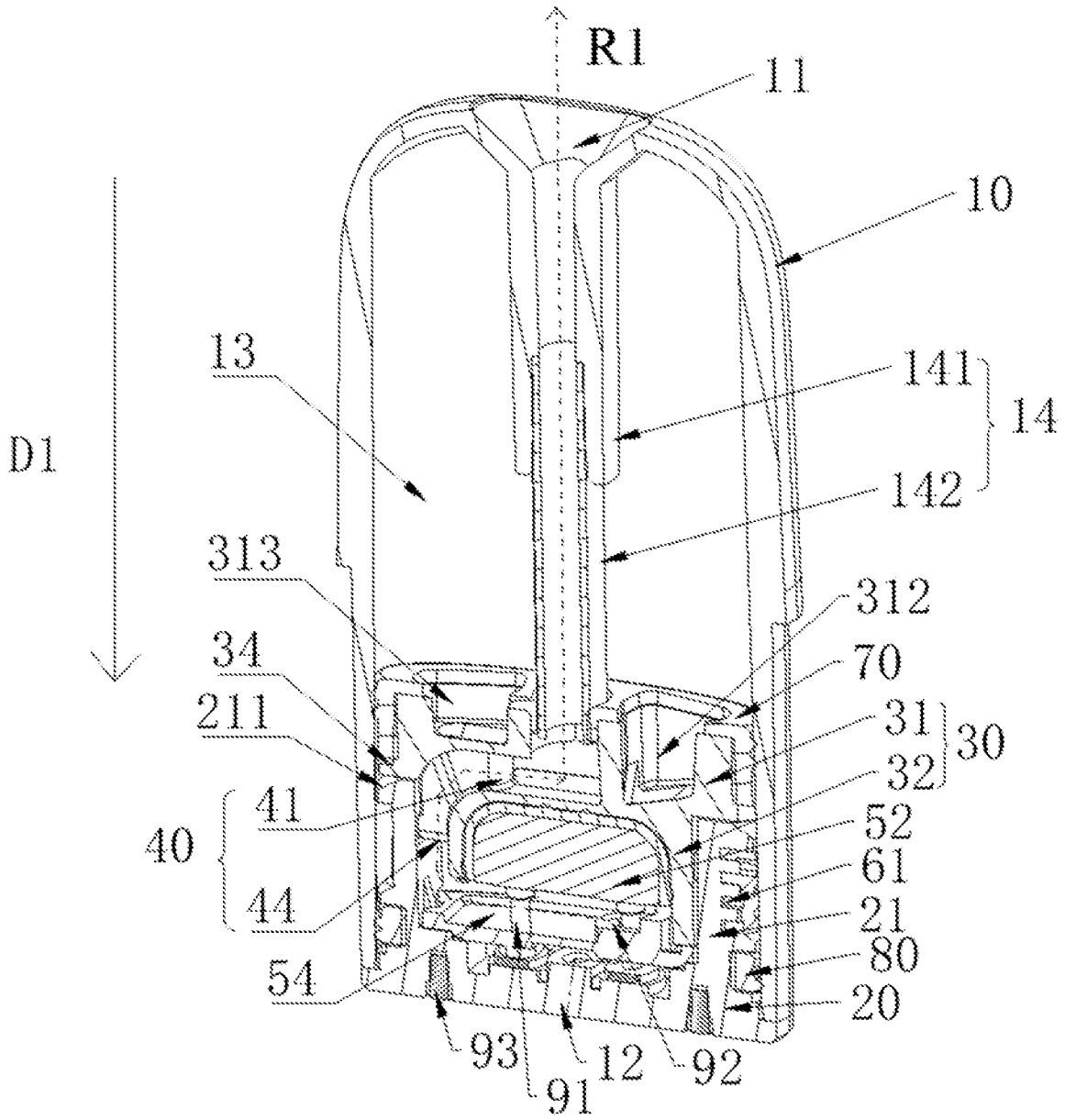
FIG. 5 is a schematic cross-sectional structural view of a plane along a length and a width of a housing of an e-cigarette cartridge according to an embodiment of this application.
Figure 6:
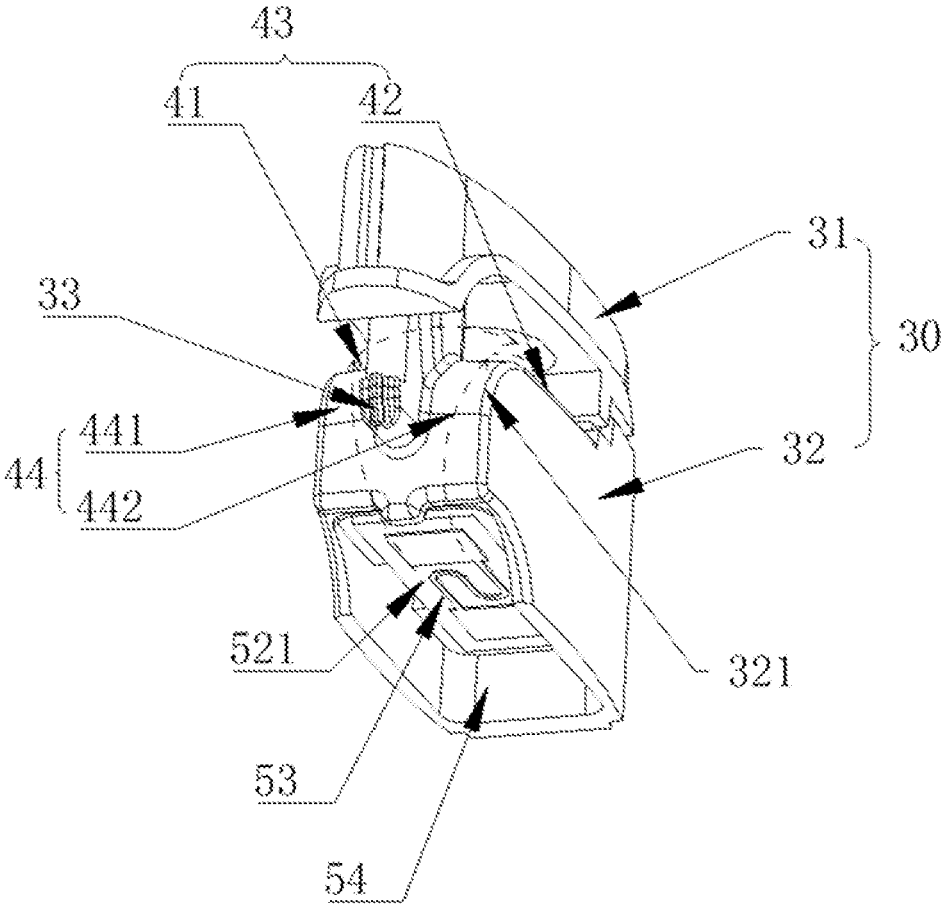
FIG. 6 is a schematic three-dimensional structural diagram of a support frame, a porous body, and a heating element according to an embodiment of this application.

As shown in FIG. 2, FIG. 5, and FIG. 6, in this embodiment of this application, the vapor output channel 40 further includes a longitudinal channel part 44 extending in the longitudinal direction D1 of the housing 10. Specifically, the longitudinal channel part 44 includes a third channel part 441 and a fourth channel part 442, where the third channel part 441 is in airflow communication between the first channel part 41 and the vaporization cavity 54; and the fourth channel part 442 is in airflow communication between the first channel part 41 and the vaporization cavity 54. In this way, the vapor output channel 40 in this embodiment of this application forms double channels, and the vapor output channel 40 is in a shape of a broken line to lengthen the path of the vapor output channel 40. In another embodiment, the longitudinal channel part 44 may alternatively include only the third channel part 441, where one end of the third channel part 441 is in airflow communication with the vaporization cavity 54, and the other end of the third channel part 441 is in airflow communication with the first channel part 41 and the second channel part 42. In this embodiment of this application, the air passes through the air inlet 12 to enter the vaporization cavity 54, and the air drives the aerosol in the vaporization cavity 54 to circulate in the direction of the width L of the housing 10, pass through the longitudinal channel part 44, flow through the first channel part 41 and the second channel part 42, and flow out from the air outlet 11. An airflow direction of the aerosol in the vaporization cavity 54 driven by the air is opposite to an airflow direction of the first channel part 41 and the second channel part 42.

The porous body 52 in this embodiment of this application includes porous ceramic. The porous body 52 is in fluid communication with the liquid storage cavity 13, so that the porous body 52 can adsorb and store the liquid substrate and transport the liquid substrate onto the heating element 53. The heating element 53 heats and vaporizes the liquid substrate that is adsorbed and stored by the porous body 52, so that the aerosol generated by heating is formed in the vaporization cavity 54. In another embodiment, a material of the porous body 52 may alternatively be another type of porous and high-temperature resistant material. In this embodiment of this application, the heating element 53 is a heating wire.

In an embodiment of this application, the support frame 30 includes a first part 31 and a second part 32 facing away from each other in the longitudinal direction D1, where the liquid storage cavity 13 is defined between the first part 31 and the housing 10, and the second part 32 provides the porous body 52 with support and holding; and the vapor output channel 40 includes a hollow cavity 43 formed between the first part 31 and the second part 32. Specifically, in this embodiment of this application, the first part 31 faces a side of the near end 110, the second part 32 faces a side of the far end 120, and the defined liquid storage cavity 13 is close to the side of the near end 110; and the first part 31 and the second part 32 are integrally connected to each other.

In this embodiment of this application, the hollow cavity 43 is internally provided with a separating part 33 extending between the first part 31 and the second part 32, and the separating part 33 separates the hollow cavity 43 to form the first channel part 41 and the second channel part 42. As shown in FIG. 6, a dashed line with an arrow in the figure indicates a path through which gas flows. In this embodiment of this application, the separating part 33 is arranged to separate the hollow cavity 43 into two channel parts, so that the mixed gas of the vaporized aerosol and the air circulates through the two channels, and finally circulates to the air outlet 11 and is discharged.

In this embodiment of this application, still as shown in FIG. 5 and FIG. 6, the second part 32 has an airflow guiding surface 321 opposite to the first part 31, and the airflow guiding surface 321 is constructed into a sloping arrangement. Specifically, in this embodiment of this application, the airflow guiding surface 321 is arranged as an arc surface, and the arc surface is curved toward a side of the porous body 52 and is configured to guide the mixed gas of the aerosol flowing out from the vaporization cavity 54 and the air to circulate toward the air outlet 11. In another embodiment, the airflow guiding surface 321 may alternatively be arranged as a sloping plane, making it convenient to guide an airflow to flow out toward the air outlet 11.

Figure 4:
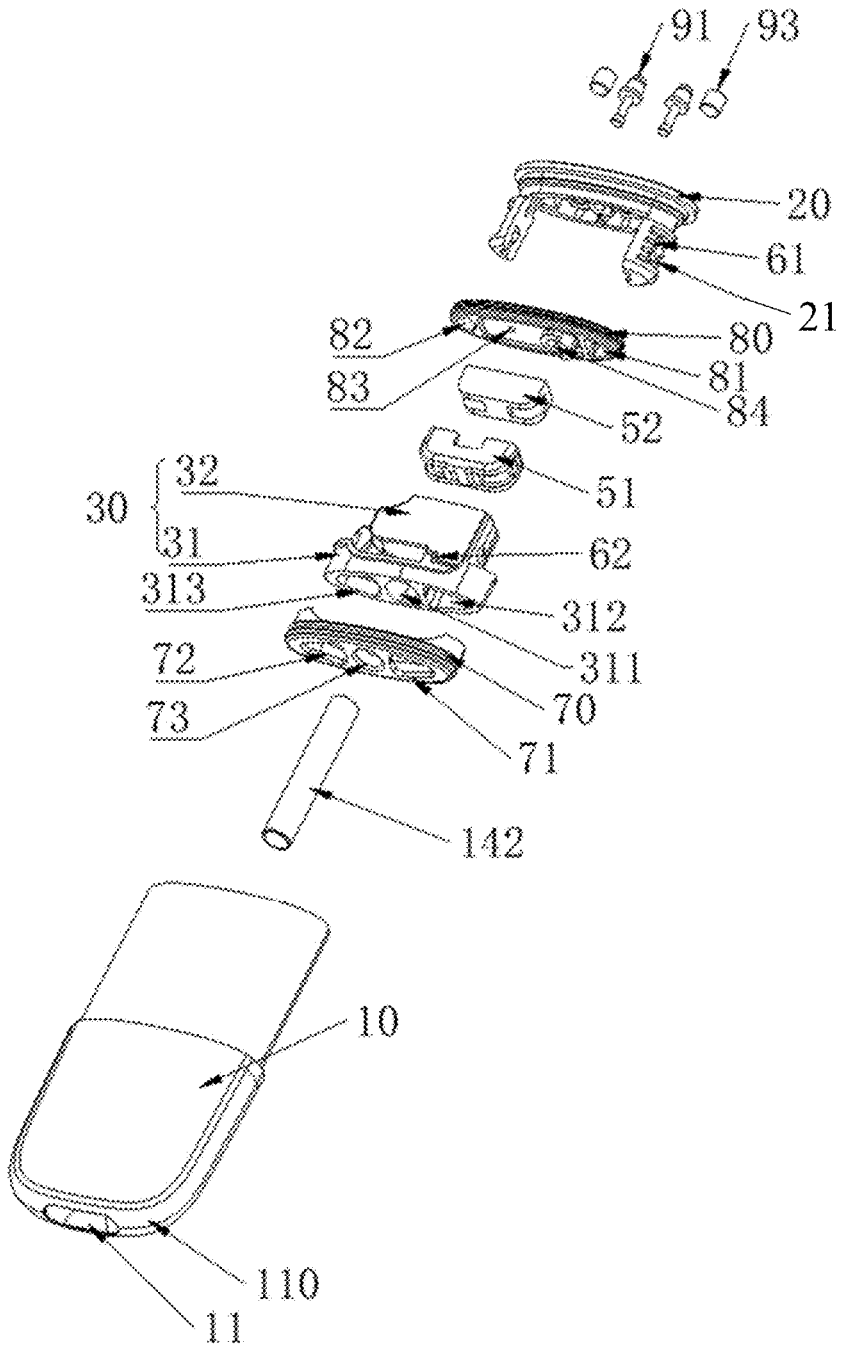
FIG. 4 is a schematic exploded structural diagram from another perspective of an e-cigarette cartridge according to an embodiment of this application.

In an embodiment of this application, as shown in FIG. 4 and FIG. 5, a first end of the first part 31 is connected to the second part 32, and a second end is connected to the separating part 33; and a smoke outlet hole 311 is formed between the first end and the second end of the first part 31, and the smoke outlet hole 311 is in communication with the air outlet 11. In this embodiment of this application, two ends of the first part 31 in the direction of the width L (referring to FIG. 2) of the housing 10 are respectively the first end and the second end. In this embodiment of this application, the first end of the first part 31 is connected to the second part 32, the second end of the first part 31 is connected to the separating part 33, a part between the first end and the second end of the first part 31 and the second part 32 form the first channel part 41 and the second channel part 42, and the smoke outlet hole 311 is formed between the first end and the second end of the first part 31, so that the first channel part 41 and the second channel part 42 are in communication with the air outlet 11 through the smoke outlet hole 311 after converging.

In this embodiment of this application, a first liquid inlet hole 312 and a second liquid inlet hole 313 are formed on the support frame 30, where the first liquid inlet hole 312 provides a first liquid path between the liquid storage cavity 13 and the porous body 52, and the second liquid inlet hole 313 provides a second liquid path between the liquid storage cavity 13 and the porous body 52; and a pore size of the first liquid inlet hole 312 is greater than a pore size of the second liquid inlet hole 313. In another embodiment, the pore size of the second liquid inlet hole 313 may alternatively be greater than the pore size of the first liquid inlet hole 312.

Specifically, in this embodiment of this application, the first liquid inlet hole 312 is formed on the first end of the first part 31; and the second liquid inlet hole 313 is formed on the second end of the first part 31. In this embodiment of this application, two liquid inlet holes, namely, the first liquid inlet hole 312 and the second liquid inlet hole 313, are arranged, so that the first liquid inlet hole 312 and the second liquid inlet hole 313 are in communication with the liquid storage cavity 13 and the second part 32, and the liquid substrate stored in the liquid storage cavity 13 circulates onto the porous body 52 in the second part 32, making it convenient to form the aerosol by heating and vaporization of the heating element 53.

In this embodiment of this application, the pore size of the first liquid inlet hole 312 is greater than the pore size of the second liquid inlet hole 313. The pore size of the first liquid inlet hole 312 is bigger, so that the liquid substrate stored in the liquid storage cavity 13 can circulate to the second part 32 by passing through the first liquid inlet hole 312, and the air in the second part 32 can also circulate to the liquid storage cavity 13 by passing through the first liquid inlet hole 312. In this way, a pressure in the liquid storage cavity 13 and a pressure in the second part 32 can reach an equilibrium, and the liquid substrate in the liquid storage cavity 13 can circulate to the second part 32 by passing through the first liquid inlet hole 312 and the second liquid inlet hole 313. When the air in the second part 32 flows into the liquid storage cavity 13 by passing through the first liquid inlet hole 312, flowing of the liquid substrate in the liquid storage cavity 13 to the second part 32 by passing through the first liquid inlet hole 312 is affected to some extent. In this embodiment of this application, the pore size of the second liquid inlet hole 313 is smaller, and the liquid substrate stored in the liquid storage cavity 13 can be continually guided into the porous body 52 in the second part 32 by a capillary action. The aerosol generated by the heating element 53 cannot enter the second liquid inlet hole 313 due to a tension effect between the air and the aerosol, so that the liquid substrate stored in the liquid storage cavity 13 can be continually guided into the porous body 52, preventing the heating element 53 from dry heating caused by a failure of circulation of the liquid substrate in the liquid storage cavity 13 to the porous body 52 in the second part 32, and alleviating interruption of the aerosol discharged from the air outlet 11 that is caused by interruption of the aerosol. In this way, the liquid substrate in the liquid storage cavity 13 can be continually guided into the porous body 52 upon a pressure equilibrium to prevent a vaporization assembly from dry heating, so that the aerosol is continually discharged from the air outlet 11.

In this embodiment of this application, the second liquid inlet hole 313 penetrates through the separating part 33, so that the separating part 33 can separate the hollow cavity 43 between the first part 31 and the second part 32 to form the first channel part 41 and the second channel part 42, and meanwhile provide the second liquid path between the liquid storage cavity 13 and the porous body 52, and space can be saved.

In this embodiment of this application, the housing 10 includes a cylindrical body and an end cap 20, where the end cap 20 includes a support arm 21 for supporting the support frame 30. When the aerosol formed in the vaporization cavity 54 contacts a side wall of the vapor output channel 40 upon circulating through the vapor output channel 40, the aerosol tends to be condensed to form an aerosol condensate. When the aerosol condensate is discharged into a user's mouth by passing through the air outlet 11, experience of the user is affected. Therefore, in this embodiment of this application, a first liquid storage groove 61 is arranged to store the aerosol condensate and alleviate outflow of the aerosol condensate through the air outlet 11.

Specifically, in this embodiment of this application, as shown in FIG. 4 and FIG. 5, the support arm 21 is provided with the first liquid storage groove 61 in communication with the vaporization cavity 54, to adsorb by the capillary action and hold the aerosol condensate in the vaporization cavity 54. The first liquid storage groove 61 is arranged to adsorb the aerosol condensate by the capillary action in the first liquid storage groove 61. The aerosol condensate can be easily stored in the first liquid storage groove 61 by the capillary action. Specifically, in this embodiment of this application, the support arm 21 is arranged on an end portion in the direction of the width L (referring to FIG. 2) of the housing 10, so that the first liquid storage groove 61 can be arranged inside the housing 10 and on the end portion in the direction of the width L of the housing 10. In this embodiment of this application, the first liquid storage groove 61 is arranged on the support arm 21, so that the first liquid storage groove 61 and the end cap 20 can be integrally formed, which makes manufacturing and assembling of the e-cigarette cartridge convenient.

Specifically, in this embodiment of this application, the support frame 30 is further provided with a second liquid storage groove 62, where the second liquid storage groove 62 is in airflow communication with the vapor output channel 40, to further adsorb by the capillary action and hold the aerosol condensate in the vapor output channel 40. The second liquid storage groove 62, in an aspect, has a function for storing the aerosol condensate, and in another aspect, has a function for transporting the aerosol condensate, making it convenient for the aerosol condensate in the vapor output channel 40 to be outputted through the second liquid storage groove 62. In this embodiment of this application, the second liquid storage groove 62 is arranged along a surface of the support frame 30, and the second liquid storage groove 62 is in a shape of a broken line. In another embodiment, the second liquid storage groove 62 may alternatively be in a shape of a curved line, or may be a combination of a shape of a curved line and a shape of a straight line.

Specifically, in this embodiment of this application, the second liquid storage groove 62 is in fluid communication with the first liquid storage groove 61, to transport the aerosol condensate in the second liquid storage groove 62 to the first liquid storage groove 61, making it convenient to transport the aerosol condensate in the vapor output channel 40 to the first liquid storage groove 61 for storage, thereby improving transport and storage effects of the aerosol condensate and reducing a probability and a volume of output of the aerosol condensate from the air outlet 11.

Figure 3:
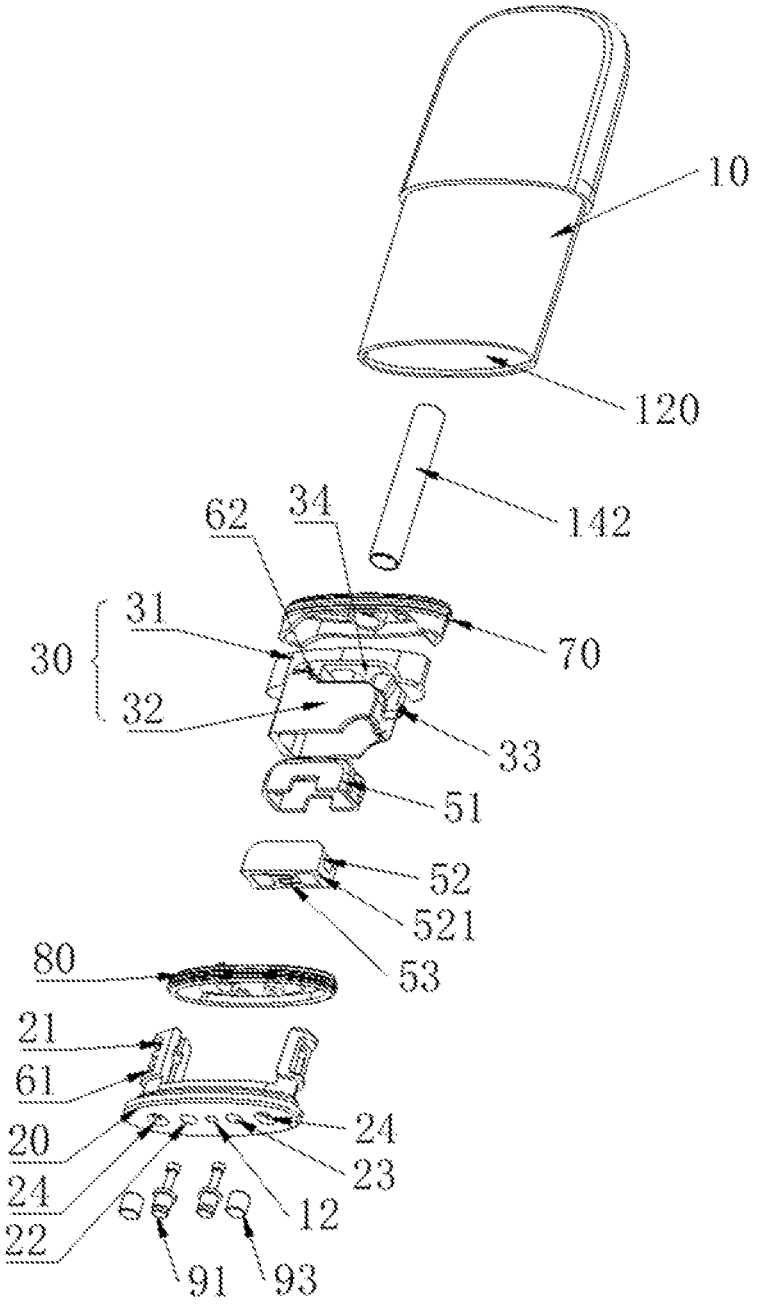
FIG. 3 is a schematic exploded structural diagram from a perspective of an e-cigarette cartridge according to an embodiment of this application.

In this embodiment of this application, still as shown in FIG. 3 to FIG. 5, the e-cigarette cartridge further includes an airflow tube 14. The airflow tube 14 is arranged inside the liquid storage cavity 13 and is in communication between the smoke outlet hole 311 and the air outlet 11, making it convenient for a mixture of the aerosol and the air circulating through the first channel part 41 and the second channel part 42 to circulate to the air outlet 11 by passing through the airflow tube 14. Specifically, in this embodiment of this application, the airflow tube 14 includes a first branch tube 141 and a second branch tube 142, where the first branch tube 141 and the housing 10 are integrally formed, the first branch tube 141 is in communication with the air outlet 11, one end of the second branch tube 142 is sleeved on one end of the first branch tube 141 that is distant from the air outlet 11, and the other end of the second branch tube 142 is inserted in the smoke outlet hole 311. In this embodiment of this application, the airflow tube 14 is provided with two branch tubes, so that a length of the airflow tube 14 can be adjusted according to requirements, making it convenient for the smoke outlet hole 311 of the support frame 30 to match the airflow tube 14. In another embodiment, a plurality of mutually-nested branch tubes may alternatively be arranged; or only one branch tube may be arranged, that is, the whole airflow tube 14 and the housing 10 are integrally formed, one end of the airflow tube 14 and the air outlet 11 are integrally formed and are in communication with each other, and the other end of the airflow tube 14 is inserted in the smoke outlet hole 311.

In this embodiment of this application, a first seal structure 70 is arranged between one end of the support frame 30 that faces the air outlet 11 and the housing 10. The first seal structure 70 is arranged to seal the support frame 30 and the housing 10, to prevent the liquid substrate stored in the liquid storage cavity 13 from being leaked to the housing 10 except the liquid storage cavity due to a sealing failure. Specifically, in this embodiment of this application, the first seal structure 70 is sleeved on an outer circumference of the first part 31 of the support frame 30, one part of the first seal structure 70 is located between an inner side wall of the housing 10 and the first part 31, and the other part of the first seal structure 70 is located between the liquid storage cavity 13 and the first part 31. In this embodiment of this application, the part of the first seal structure 70 that is located between the liquid storage cavity 13 and the first part 31 is provided with a first through hole 71, a second through hole 72, and a plugging hole 73, where the first through hole 71 is arranged to directly face the first liquid inlet hole 312, and the second through hole 72 is arranged to directly face the second liquid inlet hole 313, so that the first seal structure 70 does not affect the first liquid inlet hole 312 and the second liquid inlet hole 313. In this embodiment of this application, the plugging hole 73 is arranged to directly face the smoke outlet hole 311, and the part of the first seal structure 70 with the plugging hole 73 is arranged inside the smoke outlet hole 311, so that the part of the first seal structure 70 with the plugging hole 73 is located between the smoke outlet hole 311 and the airflow tube 14, to seal the airflow tube 14 and the smoke outlet hole 311.

Still as shown in FIG. 3 to FIG. 5, in this embodiment of this application, a second seal structure 80 is further included, where the second seal structure 80 is arranged between the end cap 20 and the support frame 30. In this embodiment of this application, the second seal structure 80 is configured to assist in sealing between the end cap 20 and the housing 10, to prevent the aerosol and other gas from being leaked from a side of the end cap 20. In addition, the second seal structure 80 includes a seal member made of a hard material that is configured to support the end cap 20 and fix the end cap inside the housing 10 and on the end portion of the housing 10. In this embodiment of this application, the second seal structure 80 parallel to an end surface of the far end 120 is provided with several mounting holes. In this embodiment of this application, four mounting holes are included, and are a first mounting hole 81, a second mounting hole 82, a third mounting hole 83, and a fourth mounting hole 84 respectively, where a part of the end cap 20 penetrates through the first mounting hole 81 and the second mounting hole 82, and fixes the second seal structure 80 on the end cap 20.

In this embodiment of this application, as shown in FIG. 5, the support arm 21 includes a support portion 211, where the support portion 211 is used for mutual clamping with a limiting portion 34 of the support frame 30, making it convenient to fix and limit a relative position between the support frame 30 and the end cap 20, and the support portion 211 is configured to assist in supporting the support frame 30.

In this embodiment of this application, as shown in FIG. 2, FIG. 3, and FIG. 5, the air inlet 12 is arranged on the end cap 20, and the end cap 20 further includes a third through hole 22, a fourth through hole 23, and two blind holes 24, where the third through hole 22 and the fourth through hole 23 are configured to penetrate through an electrode 91, and the electrode 91 penetrates through the third mounting hole 83 and the fourth mounting hole 84 of the second seal structure 80. In addition, one end of the electrode 91 is electrically connected to the heating element 53, and the other end of the electrode 91 is configured to be electrically connected to a power supply device 200 (referring to FIG. 7), so that the power supply device 200 supplies power to the heating element 53 to enable the heating element 53 to work. In this embodiment of this application, a ventilation seal member 92 is arranged between the third mounting hole 83 and the electrode 91. The ventilation seal member 92 in this embodiment of this application is made of silicone, and the ventilation seal member 92 in this embodiment of this application can allow the air flowing into the air inlet 12 on the end cap 20 to flow into the second part 32 by passing through the ventilation seal member 92. In this embodiment of this application, the blind holes 24 are configured to fix magnetic adsorption members 93, where the magnetic adsorption members 93 are configured to adsorb the power supply device 200 and fix the power supply device 200 to the e-cigarette cartridge.

In this embodiment of this application, as shown in FIG. 3 and FIG. 4, the vaporization assembly includes a silicone sleeve 51, where the silicone sleeve 51 is sleeved on the porous body 52, and the silicone sleeve 51 is provided with a hole structure (not shown in the figures), making it convenient for the liquid substrate to flow to the porous body 52 by passing through the hole structure. In this embodiment of this application, the silicone sleeve 51 is configured to buffer the porous body 52 and the second part 32 of the support frame 30, so that the aerosol generated by vaporization of the vaporization assembly is located inside the vaporization cavity 54. By arranging the silicone sleeve 51, a probability that the aerosol reaches a position in the second part 32 other than a position of the vaporization cavity is reduced, condensation of the aerosol in the second part 32 is reduced, and utilization of the aerosol is improved.

In this embodiment of this application, as shown in FIG. 5, a dashed line R1 with an arrow in the figure indicates a path through which gas flows. The air circulates to the e-cigarette cartridge by passing through the air inlet 12 of the end cap 20, and circulates to the vaporization cavity 54 by passing through the ventilation seal member 92 between the second seal structure and the electrode 91; and the heating element 53 heats and vaporizes the liquid substrate to form the aerosol in the vaporization cavity 54, the air drives the aerosol in the vaporization cavity 54 to circulate from the vaporization cavity 54 to the longitudinal channel part 44, subsequently flow to the first channel part 41 and the second channel part 42, and circulate to the airflow tube 14 by passing through the smoke outlet hole 311, and the mixed gas of the aerosol and the air is discharged from the air outlet 11, so that the mixed gas can reach a user's mouth. In this embodiment of this application, the aerosol and the air can be mixed in the vaporization cavity 54 and the vapor output channel 40. In this embodiment of this application, a channel distance formed by the vapor output channel 40 is longer without increasing the volume of the housing 10 of the e-cigarette cartridge, so that the aerosol and the air can be uniformly mixed, and mixing uniformity of the aerosol and the air is improved. In this embodiment of this application, the aerosol condensate formed by the mixed gas of the aerosol and the air after passing through the vapor output channel 40 can circulate to the first liquid storage groove 61 for storage by passing through the second liquid storage groove 62, thereby reducing the volume of the aerosol condensate discharged from the air outlet 11.

Figure 7:
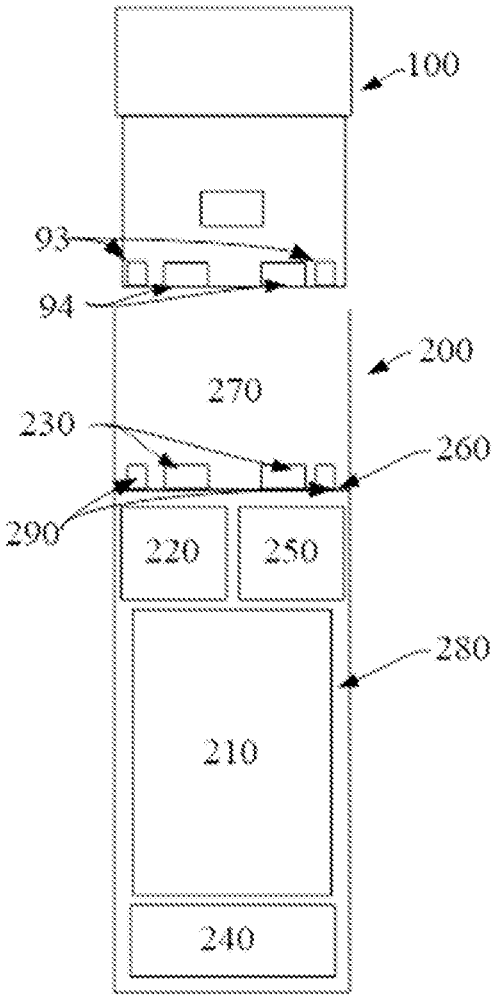
FIG. 7 is a schematic structural diagram of an e-cigarette according to an embodiment of this application.

The embodiments of this application further include a second technical solution. As shown in FIG. 7, an e-cigarette is provided, including the foregoing e-cigarette cartridge 100 and a power supply device for supplying power to the e-cigarette cartridge 100. The e-cigarette cartridge 100 is shown in FIG. 1 to FIG. 6. In this embodiment of this application, the power supply device 200 is provided with accessories 290 corresponding to the magnetic adsorption members 93 on the e-cigarette cartridge 100. In this embodiment of this application, the magnetic adsorption member 93 is a permanent magnet, and the accessory 290 is a sheet member made of iron, cobalt, nickel, or other materials. In another embodiment, the magnetic adsorption member 93 may alternatively be a columnar member made of iron, cobalt, nickel, or other materials, and the accessory is a permanent magnet.

In the e-cigarette adopting the foregoing e-cigarette cartridge, air enters the second part 32 by passing through the air inlet 12, and circulates to the air outlet 11 by passing through the vapor output channel 40, where the vapor output channel 40 has a longer path, so that the air and the aerosol can be uniformly mixed, uniformity of the mixed gas of the air and the aerosol that is discharged from the air outlet 11 is high, and user experience is improved.

In an embodiment of this application, as shown in FIG. 7, the power supply device 200 includes: a receiving cavity 270 arranged at an end in a length direction and configured to receive and accommodate at least a part of the cartridge 100, and a first electrical contact 230 at least partially exposed on a surface of the receiving cavity 270 and configured to be electrically connected to the cartridge 100 to supply power to the cartridge 100 when the at least a part of the cartridge 100 is received or accommodated in the power supply device 200.

In an embodiment of this application, as shown in FIG. 7, an end portion of the cartridge 100 opposite to the power supply device 200 in a longitudinal direction is provided with a second electrical contact 94, where the second electrical contact 94 is electrically connected to the electrode 91 of the cartridge, so that when the at least a part of the cartridge 100 is accommodated in the receiving cavity 270, the second electrical contact 94 comes into contact with and abuts against the first electrical contact 230 to conduct electricity.

The power supply device 200 is internally provided with a seal member 260, at least a part of an internal space of the power supply device 200 is separated through the seal member 260 to form the receiving cavity 270, and a cavity 280 formed by separating the other part is configured to arrange a battery cell 220, a controller 220, and a sensor 250. The battery cell 210 is configured to supply power. The controller 220 operably conducts a current between the battery cell 210 and the first electrical contact 230. In a preferred implementation shown in FIG. 7, the seal member 260 is constructed to extend in a cross-sectional direction of the power supply device 200, and is made of a flexible material, so as to prevent the liquid substrate seeping from the cartridge 100 to the receiving cavity 270 from flowing to the controller 220, the sensor 250, and other components inside the power supply device 200.

The battery cell 210 is configured to supply power. The controller 220 operably conducts a current between the battery cell 210 and the first electrical contact 230. The sensor 250 is configured to sense a suction airflow generated by the cartridge 100 upon suction, so that the controller 220 controls the battery cell 210 to output the current to the cartridge 100 according to a detection signal of the sensor 250.

In an embodiment of this application, a charging interface 240 is further arranged in the cavity 280 of the power supply device 200, and configured to charge the battery cell 210 after being connected to an external charging device.

The foregoing descriptions are merely implementations of this application but are not intended to limit the patent scope of this application. An equivalent structural or equivalent process alternation made by using the content of the specification and the accompanying drawings of this application for direct or indirect use in other relevant technical fields shall also be encompassed in the patent protection scope of this application.

What is claimed is:

1. An e-cigarette cartridge, comprising a housing with a near end and a far end facing away from each other in a longitudinal direction, wherein the far end is provided with an air inlet and the near end is provided with an air outlet; and the housing is internally provided with:

a liquid storage cavity, configured to store a liquid substrate;

a porous body, being in fluid communication with the liquid storage cavity to suck the liquid substrate and having a vaporization surface;

a vaporization cavity, at least partially defined by the vaporization surface, wherein the vaporization cavity is in airflow communication with the air inlet;

a heating element, formed on the vaporization surface and configured to heat at least a part of the liquid substrate in the porous body to generate an aerosol;

a support frame, constructed to support and hold the porous body; and a vapor output channel, comprising a first channel part and a second channel part that are formed on the support frame and extend in a direction of a width of the housing, wherein one end of the first channel part is in airflow communication with the vaporization cavity and the other end is in airflow communication with the air outlet; one end of the second channel part is in airflow communication with the vaporization cavity and the other end is in airflow communication with the air outlet; and further the aerosol in the vaporization cavity is divided into a first flow along the first channel part and a second flow along the second channel part in use, and then the first flow and the second flow are merged and outputted to the air outlet, wherein the first flow and the second flow have a same flowing direction along the direction of the width of the housing wherein the support frame comprises a first part and a second part facing away from each other in the longitudinal direction, wherein the liquid storage cavity is defined between the first part and the housing, and the second part supports and holds the porous body; and the vapor output channel comprises a hollow cavity formed between the first part and the second part;

where in the hollow cavity is internally provided with a separating part extending between the first part and the second part, and the separating part separates the hollow cavity to form the first channel part and the second channel part.

2. The e-cigarette cartridge according to claim 1, wherein the housing comprises a cylindrical body and an end cap, wherein the end cap comprises a support arm for supporting the support frame, wherein the support arm is provided with a first liquid storage groove in communication with the vaporization cavity, to adsorb by a capillary action and hold an aerosol condensate in the vaporization cavity.

3. The e-cigarette cartridge according to claim 2, wherein the support frame is further provided with a second liquid storage groove, wherein the second liquid storage groove is in airflow communication with the vapor output channel, to further adsorb by the capillary action and hold the aerosol condensate in the vapor output channel.

4. The e-cigarette cartridge according to claim 3, wherein the second liquid storage groove is in fluid communication with the first liquid storage groove, to transport the aerosol condensate in the second liquid storage groove to the first liquid storage groove.

5. An e-cigarette, comprising the e-cigarette cartridge according to claim 1 and a power supply device for supplying power to the e-cigarette cartridge.

6. The e-cigarette cartridge according to claim 1, wherein the second part has an airflow guiding surface opposite to the first part, and the airflow guiding surface is constructed into a sloping arrangement.

7. The e-cigarette cartridge according to claim 1, wherein the separating part is a separating plate that extends in the direction of the width of the housing, and wherein the first channel part and the second channel part extend along opposite sides of the separating plate.

8. The e-cigarette cartridge according to claim 1, wherein a first liquid inlet hole and a second liquid inlet hole are formed on the support frame, wherein the first liquid inlet hole provides a first liquid path between the liquid storage cavity and the porous body, and the second liquid inlet hole provides a second liquid path between the liquid storage cavity and the porous body; and a pore size of the first liquid inlet hole is greater than a pore size of the second liquid inlet hole, or the pore size of the second liquid inlet hole is greater than the pore size of the first liquid inlet hole.

9. The e-cigarette cartridge according to claim 8, wherein the second liquid inlet hole penetrates through the separating part.

* * * * *